US012121108B2

(12) United States Patent
Cook et al.

(10) Patent No.: US 12,121,108 B2
(45) Date of Patent: Oct. 22, 2024

(54) CYCLING SHOE LACING SYSTEM

(71) Applicant: Specialized Bicycle Components, Inc., Morgan Hill, CA (US)

(72) Inventors: Robert Arthur Laurence Cook, Bayern (DE); Ashley Gill Sult, Santa Clara, CA (US)

(73) Assignee: Specialized Bicycle Components, Inc., Morgan Hill, CA (US)

( * ) Notice: Subject to any disclaimer, the term of this patent is extended or adjusted under 35 U.S.C. 154(b) by 0 days.

(21) Appl. No.: 17/388,368

(22) Filed: Jul. 29, 2021

(65) Prior Publication Data

US 2022/0031024 A1 Feb. 3, 2022

Related U.S. Application Data

(60) Provisional application No. 63/059,602, filed on Jul. 31, 2020.

(51) Int. Cl.
*A43C 11/16* (2006.01)
*A43C 11/00* (2006.01)

(52) U.S. Cl.
CPC ..... *A43C 11/165* (2013.01); *A43C 11/008* (2013.01)

(58) Field of Classification Search
CPC ..... A43C 11/165; A43C 11/008; A43C 11/20; A43C 1/003; A43B 5/14
See application file for complete search history.

(56) References Cited

U.S. PATENT DOCUMENTS

| | | | | |
|---|---|---|---|---|
| 4,845,864 | A | 7/1989 | Corliss | |
| 5,392,535 | A * | 2/1995 | Van Noy | A43C 11/00 36/88 |
| 5,943,795 | A | 8/1999 | Ueda et al. | |
| 6,922,917 | B2 | 8/2005 | Kerns et al. | |
| 9,125,455 | B2 | 9/2015 | Kerns et al. | |

(Continued)

FOREIGN PATENT DOCUMENTS

| | | |
|---|---|---|
| EP | 0895728 B1 | 4/2002 |
| EP | 3332660 A1 | 6/2018 |

(Continued)

OTHER PUBLICATIONS

European Patent Office Search Report and Written Opinion for Application No. 21188213.9 dated Dec. 2, 2021 (8 pages).

*Primary Examiner* — Bao-Thieu L Nguyen
(74) *Attorney, Agent, or Firm* — Michael Best & Friedrich LLP

(57) ABSTRACT

A shoe includes an outsole, a first upper portion, a second upper portion, a rotary dial mounted to the first upper portion, and first and second lace portions coupled between the rotary dial and the second upper portion. The first lace portion aligns with a heel region of the shoe, the second lace portion aligns with a pedal region of the outsole, and a closure center line aligns with a medial arch region of the outsole. The second upper portion includes first and second lace guides. The first upper portion includes a third lace guide between the first and second lace portions. The first and second lace portions define a unitary lace extending from the rotary dial, through the first, second, and third lace guides, and back to the rotary dial. No portion of the lace member crosses over another portion of the lace member outside of the rotary dial.

11 Claims, 8 Drawing Sheets

(56) References Cited

U.S. PATENT DOCUMENTS

| | | | | |
|---|---|---|---|---|
| D789,047 | S * | 6/2017 | Bruder | D2/902 |
| 9,867,430 | B2 | 1/2018 | Hammerslag et al. | |
| D817,621 | S * | 5/2018 | Madore | D2/969 |
| D846,868 | S * | 4/2019 | Chanthavong | D2/974 |
| 10,405,601 | B2 * | 9/2019 | Kuefler | A43B 23/0245 |
| 10,575,591 | B2 * | 3/2020 | Schum | B62K 23/02 |
| D943,945 | S * | 2/2022 | Cook | D2/972 |
| 2002/0088141 | A1 * | 7/2002 | Matis | A43B 3/128 36/12 |
| 2005/0022427 | A1 * | 2/2005 | Kerns | A43C 11/16 36/50.1 |
| 2008/0022561 | A1 * | 1/2008 | Klavano | A43B 7/146 36/141 |
| 2012/0004587 | A1 * | 1/2012 | Nickel | A61F 5/028 602/5 |
| 2013/0008057 | A1 | 1/2013 | Bird et al. | |
| 2015/0257489 | A1 | 9/2015 | Trudel | |
| 2016/0044994 | A1 | 2/2016 | Soderberg et al. | |
| 2016/0157561 | A1 * | 6/2016 | Schum | A43B 3/34 242/390 |
| 2016/0213089 | A1 * | 7/2016 | Chen | A43B 23/025 |
| 2016/0309844 | A1 * | 10/2016 | Smith | A43B 3/126 |
| 2016/0338449 | A1 | 11/2016 | Steuerwald | |
| 2017/0065029 | A1 * | 3/2017 | Bordin | A43C 1/00 |
| 2017/0354207 | A1 * | 12/2017 | Signori | A43B 5/14 |
| 2018/0160764 | A1 * | 6/2018 | Garneau | A43C 11/165 |
| 2018/0199659 | A1 * | 7/2018 | Lintaman | A43C 1/006 |
| 2018/0352898 | A1 * | 12/2018 | Onoda | A43B 7/1475 |
| 2019/0069626 | A1 * | 3/2019 | Kuefler | A43B 23/0245 |
| 2019/0313740 | A1 * | 10/2019 | Workman | A43B 7/20 |
| 2019/0365021 | A1 | 12/2019 | Okajima | |
| 2020/0085144 | A1 * | 3/2020 | Chiou | A43B 11/00 |
| 2020/0189158 | A1 | 6/2020 | Hipwood et al. | |
| 2021/0196000 | A1 * | 7/2021 | Trudel | A43C 11/165 |
| 2021/0368946 | A1 * | 12/2021 | Aoki | A43C 11/165 |

FOREIGN PATENT DOCUMENTS

| | | | |
|---|---|---|---|
| JP | 2018112316 | A | 7/2018 |
| WO | 2016023093 | A1 | 2/2016 |
| WO | 2016057697 | A1 | 4/2016 |
| WO | 20170664115 | A1 | 4/2017 |
| WO | 2018160583 | A1 | 9/2018 |

* cited by examiner

CYCLING SHOE LACING SYSTEM

CROSS-REFERENCE TO RELATED APPLICATIONS

This application claims priority to U.S. Provisional Application No. 63/059,602, filed Jul. 31, 2020, the entire contents of which are incorporated herein by reference.

BACKGROUND

The present disclosure relates generally to the field of shoe lacing systems and specifically to a cycling shoe lacing system having a unique lace path.

Some shoes include lacing systems that are tightened using a rotary dial/reel that tightens the lace when the dial is rotated. Such systems are known in the art, as described in patent publications WO2018/160583 and US2020/0189158, the entire contents of which are hereby incorporated by reference in their entireties.

DETAILED DESCRIPTION

Figure 1:
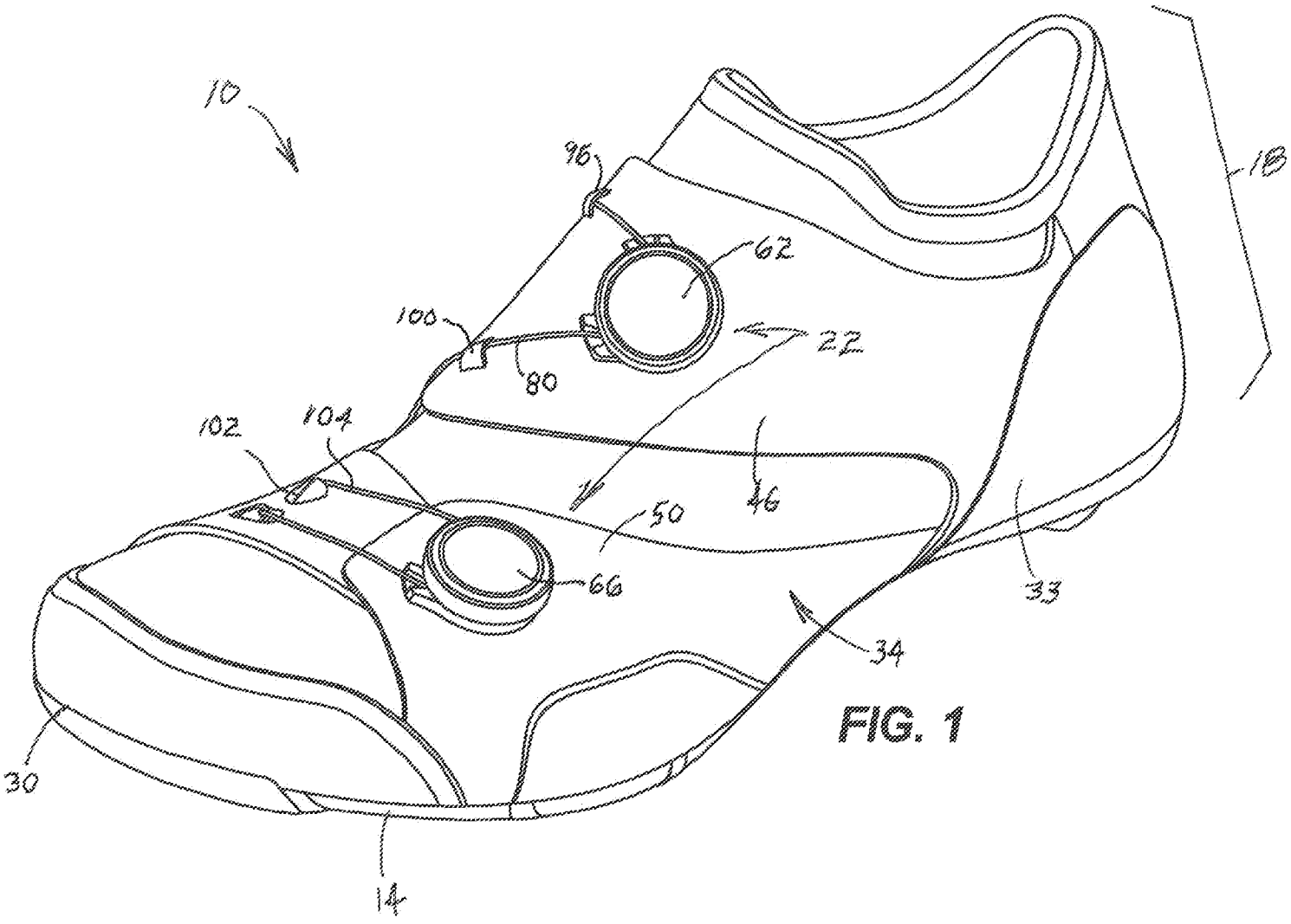
FIG. 1 is a perspective view of a lateral side of a cycling shoe according to an embodiment.
Figure 2:
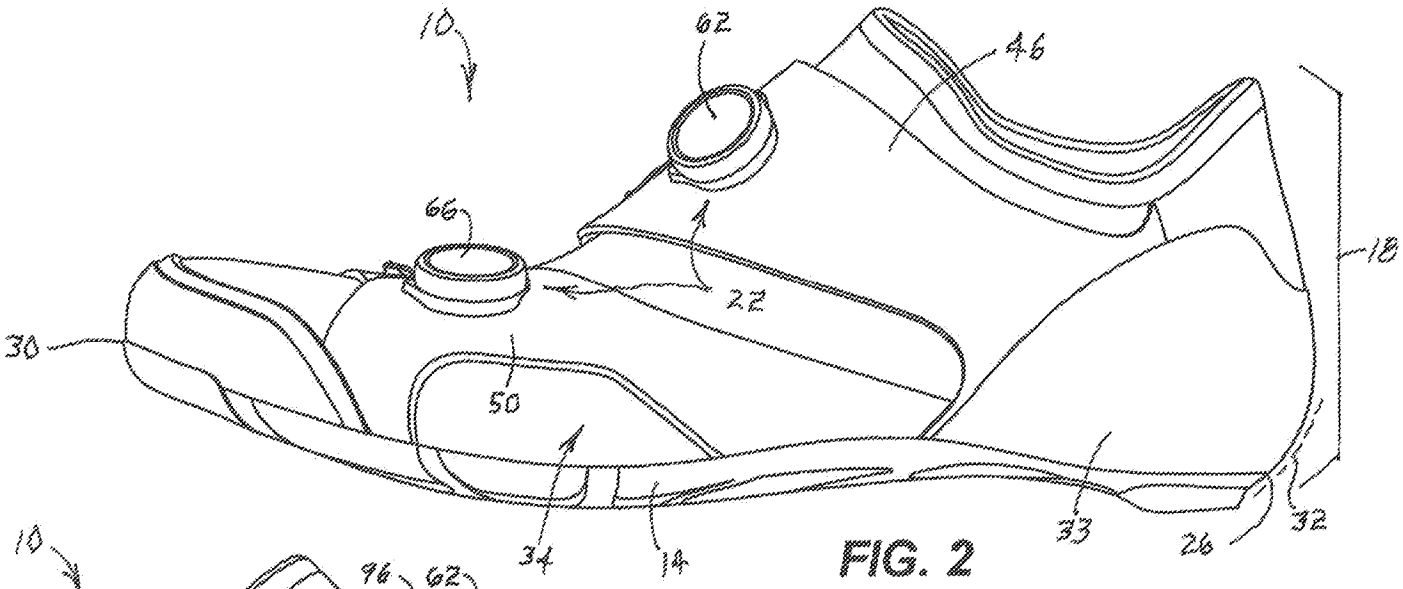
FIG. 2 is a lateral side view of the cycling shoe.

Before any embodiments are explained in detail, it is to be understood that the present disclosure is not limited in its application to the details of construction and the arrangement of components set forth in the following description or illustrated in the following drawings. The disclosure is capable of other embodiments and of being practiced or of being carried out in various ways. Further, as used herein, "shoe" is intended to refer to any item of footwear, including but not limited to shoes, boots, sandals, slippers, or any other item of footwear.

According to an exemplary embodiment, a shoe includes an outsole having a heel end, an upper coupled to the outsole and including a first upper portion (e.g., a lateral part including a strap) movable relative to a second upper portion (e.g., a medial part). The heel end of the outsole is coupled to the upper to define a heel region. The shoe also includes a lacing system including a rotary dial mounted to the first upper portion (e.g., to the strap), a first lace portion coupled between the rotary dial and the second upper portion such that rotation of the dial tightens the first lace portion, and a second lace portion coupled between the rotary dial and the second upper portion such that rotation of the rotary dial tightens the second lace portion. The first lace portion is preferably aligned with the heel region.

According to another exemplary embodiment, a shoe includes an outsole, an upper including a first upper portion movable relative to a second upper portion, and a lacing system. The lacing system includes a rotary dial mounted to the first upper portion, a first lace portion coupled between the rotary dial and the second upper portion such that rotation of the dial tightens the first lace portion, and a second lace portion coupled between the rotary dial and the second upper portion such that rotation of the rotary dial tightens the second lace portion. The second upper portion includes a first lace guide and a second lace guide. The first upper portion includes a third lace guide positioned between the first lace portion and the second lace portion. The first lace portion and second lace portion are each part of a unitary lace that extends from the rotary dial, through the first lace guide, through the third lace guide, through the second lace guide, and back to the rotary dial.

In one embodiment, the strap wraps across a longitudinal centerline of the shoe (e.g., by at least 50 mm and preferably at least 20 mm, and more preferably about 15 mm). Preferably, the first upper portion comprises a lateral part of the upper, the second upper portion comprises a medial part of the upper, and the strap comprises a lateral strap that wraps across the centerline and overlaps the medial part of the upper. In this embodiment, the rotary dial can be mounted on a lateral side of the shoe.

The outsole can define an outsole length between the heel end and toe end, a pedal region 50%-70% of the outsole length from the heel end, and a medial arch region 30%-50% of the outsole length from the heel end. The second lace portion is preferably aligned with the pedal region. The rear lacing assembly defines a closure center line that extends from a center portion of the rotary dial towards an angular midpoint between the first lace portion and the second lace portion, and the closure center line is preferably aligned with the medial arch region.

The second upper portion can include a first lace guide and a second lace guide, and the first upper portion can include a third lace guide positioned between the first lace portion and the second lace portion. In this embodiment, the first lace portion and second lace portion are each part of a unitary lace that extends from the rotary dial, through the first lace guide, through the third lace guide, through the second lace guide, and back to the rotary dial. Preferably, the first lace portion and second lace portion are both part of the same lace member, and no portion of the lace member crosses over another portion of the lace member outside of the rotary dial. The second upper portion can further include a fourth lace guide positioned between the rotary dial and the first lace guide to align the first lace portion with the first lace guide, and a fifth lace guide positioned between the rotary dial and the second lace guide to align the second lace portion with the second lace guide.

FIGS. 1-6 illustrate a clipless cycling shoe 10 including an outsole 14, an upper 18 secured to the outsole 14, and a lacing system 22 for securing the shoe to a user's foot. The outsole 14 may be formed of a rigid or stiff material (e.g., plastic or carbon fiber) and the upper 18 may be formed of any combination of a nylon, synthetic leather, leather, or other suitable material. The outsole 14 has a heel end 26, a toe end 30, and an outsole length L (FIG. 3) from the heel end 26 to the toe end 30. The illustrated connection between the heel end 26 and the upper 18 occurs at a heel corner within a heel region 32 that is reinforced with a heel counter 33. The outsole further includes a pedal region 92 that corresponds with where the ball of a user's foot would be positioned in the shoe and is roughly located where a pedal spindle would be aligned when the shoe is being used to pedal a bicycle. The pedal region 92 is from 50% to 70% of the outsole length L from the heel end 26. In the illustrated embodiment, the center of the pedal region 92 is approximately 61 percent of the outsole length L from the heel end 26.

Figure 6:
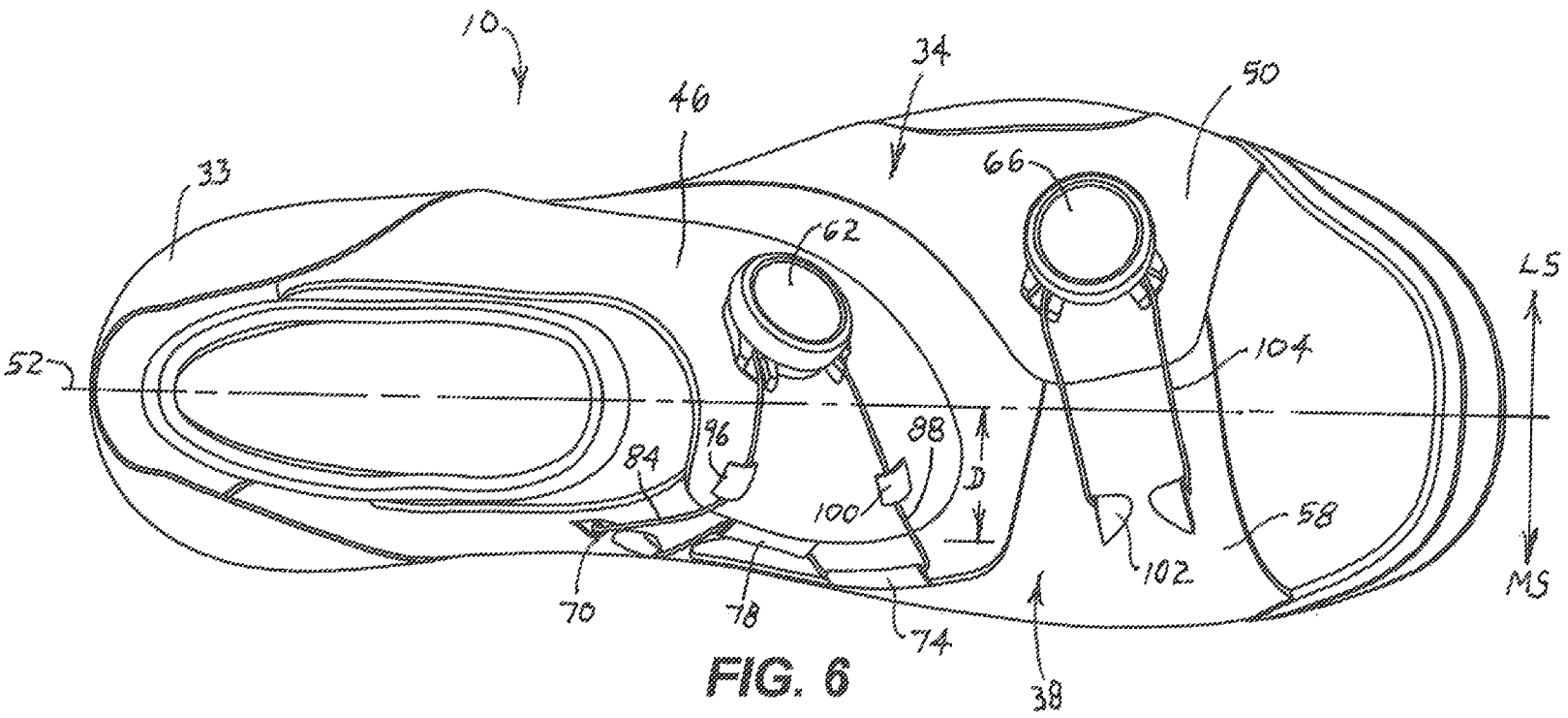
FIG. 6 is a top view of the cycling shoe.

Now with reference to FIG. 6, the shoe 10 includes a longitudinal centerline 52 that divides the shoe 10 between a lateral side LS and a medial side MS and thus divides the upper between a lateral part 34 and a medial part 38. In the illustrated embodiment, the upper 18 defines an internal volume of the shoe 10 and the overall shape of the shoe 10 (e.g., an opening of the shoe, a tongue of the shoe 10, etc.). It should be appreciated that portions of the upper 18 may be formed of a stretchable material that deforms to accommodate a user's foot. In some embodiments, portions of the upper may be formed of a knitted material that provides ventilation for the user's foot.

The illustrated lateral part 34 includes a rear lateral strap 46 and a front lateral strap 50 (these straps being called "lateral straps" because they are fixed to the lateral portion of the upper). The illustrated rear lateral strap 46 is anchored to the heel end 26 of the outsole 14 (e.g., via the heel counter 33) such that the rear lateral strap 46 is generally aligned with the heel region 32. The rear lateral strap 46 extends from the heel region and wraps across the centerline 52 of the shoe 10 such that a free end 54 that wraps beyond the centerline 52 distance D (FIG. 6) so the free end 54 is positioned on the medial side of the shoe 10. In the illustrated embodiment, the free end 54 of the rear lateral strap 46 wraps approximately 50 millimeters (mm) beyond the centerline 52. In other embodiments, the free end 54 of the rear lateral strap 46 may wrap more or less than less than 50 mm beyond the centerline 52.

The illustrated front lateral strap 50 is anchored to the outsole 14 between the rear lateral strap 46 and the toe end 30 of the outsole 14. As best shown in FIG. 6, the illustrated front lateral strap 50 does not cross the centerline 52 and thus does not overlap onto the medial part 38 of the upper 18.

Figure 3:
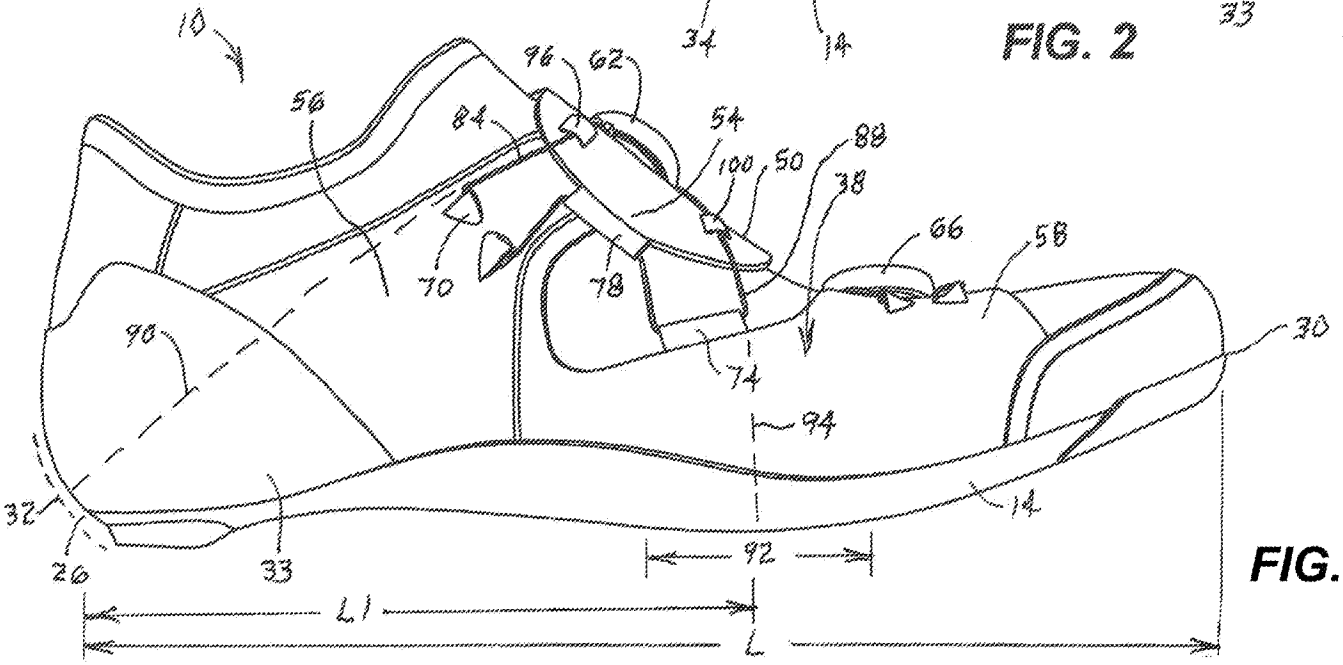
FIG. 3 is a medial side view of the cycling shoe.
Figure 4:
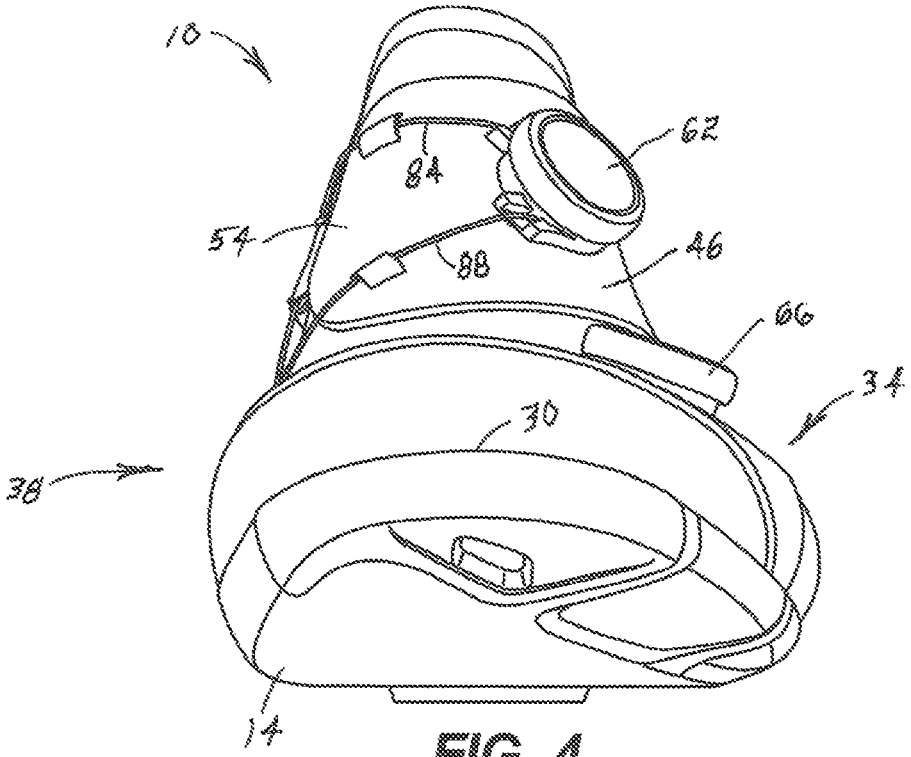
FIG. 4 is a front view of the cycling shoe.
Figure 5:
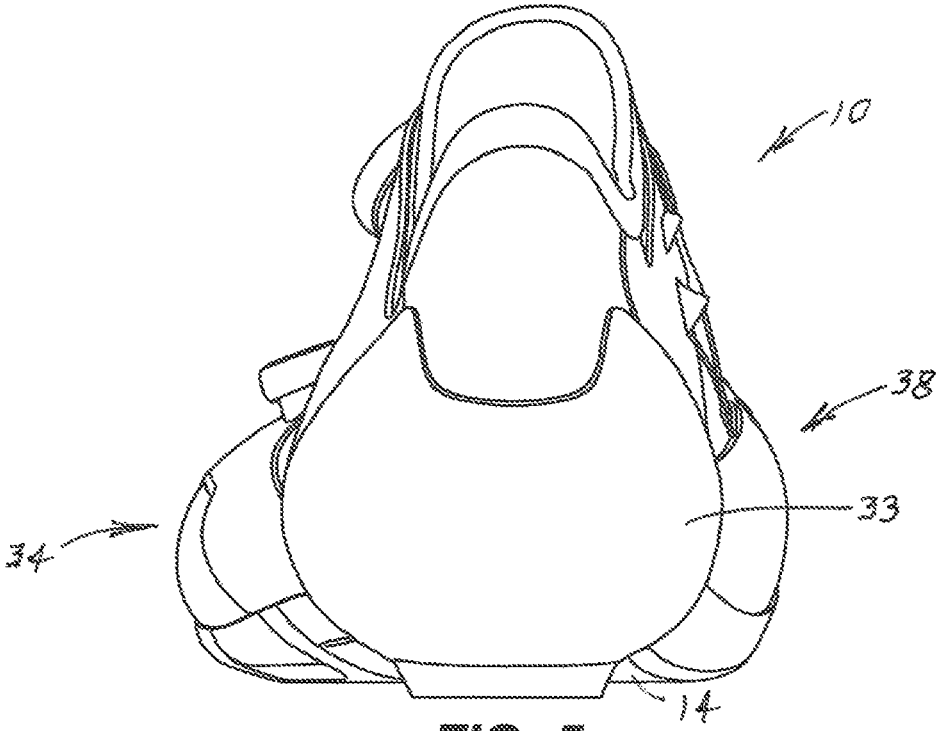
FIG. 5 is a rear view of the cycling shoe.

Now with reference to FIG. 3, the medial part 38 of the upper 18 includes a rear medial strap 56 anchored to the heel end 26 of the outsole 14 (e.g., via the heel counter 33) and a front medial strap 58 anchored to the outsole 14 adjacent the toe end 30. The rear medial strap 56 does not cross the centerline 52 and thus stays on the medial side of the shoe. As best shown in FIG. 3, the free end 54 of the rear lateral strap 46 overlaps onto the rear medial strap 56 on a medial side of the shoe.

The front medial strap 58 includes a portion that wraps across the centerline 52 of the shoe 10 and overlaps the lateral part 34 of the upper 18 on the lateral side of the shoe, as best shown in FIGS. 1 and 6. In this position, the front lateral strap 50 overlaps the front medial strap 58 on the lateral side of the shoe.

Now with reference to FIG. 6, the lacing system 22 (FIG. 1) is operable to move the lateral part 34 relative to the medial part 38 to secure the shoe 10 to a user's foot. The lacing system 22 includes a rear lacing assembly and a front lacing assembly.

The rear lacing assembly includes a rear rotary dial 62 mounted to the rear lateral strap 46, a plurality of lace guides 70,74,78, and a rear lace 80. The lace guides 70, 74, 78 include a first lace guide 70 and a second lace guide 74 that are coupled to the medial part 38 of the upper 18 and a third lace guide 78 that is coupled to the free end 54 of the rear lateral strap 46. The rear lace 80 extends from the rear rotary dial 62 and includes a rear lace portion 84 and a front lace portion 88. The rear lace portion 84 is aligned with the heel region 32 of the shoe 10 along a rear tightening path 90 and threads through the first lace guide 70. The front lace portion 88 is aligned with the pedal region 92 of the outsole 14 along a front tightening path 94 and threads through the second lace guide 74. The third lace guide 78 is positioned between the rear lace portion 84 and the front lace portion 88. The rear lace 80 extends from the rear rotary dial 62, through the first lace guide 70, through the third lace guide 78, through the second lace guide 74, and back to the rear rotary dial 62. Rotation of the rear rotary dial 62 in one direction tightens both the rear lace portion 84 and the front lace portion 88, which moves the rear lateral strap 46 toward the rear medial strap 56. The positioning of the lace guides 70, 74, 78, allows the tension on the rear lateral strap 46 to be more uniformly distributed across the rear lateral strap 46 toward the medial side of the shoe so a heel portion and a ball portion of the user's foot are secured within the shoe 10. It is further noted that the rear lace portion 84 and front lace portion 88 are both part of the same lace member (i.e., the rear lace 80), and no portion of the rear lace 80 outside the rear rotary dial 62 crosses over another portion of the rear lace 80.

The lacing system 22 may further include fourth and fifth lace guides 96, 100 that are coupled to the rear lateral strap 46. The fourth lace guide 96 is positioned between the rear rotary dial 62 and the first lace guide 70 and the fifth lace guide 100 is positioned between the first rotary dial 62 and the second lace guide 74. The fourth and fifth lace guides 96, 100 respectively align the rear lace portion 84 with the first lace guide 70 and align the front lace portion 88 with the second lace guide 74.

Now with reference to FIG. 6, the front lacing assembly includes front rotary dial 66 mounted to the front lateral strap 50, a sixth lace guide 102, and a front lace 104. In the illustrated embodiment, the front lace 104 extends from the second rotary dial 66, through the sixth lace guide 102 and back to the front rotary dial 66. As such, rotation of the front rotary dial 66 tightens the front lace 104 and secures a front portion of the user's foot within the shoe 10. In should be appreciated that other securing mechanisms such as a strap having a hook and loop fastener may be used instead of the front lacing assembly.

Now with reference to FIGS. 6-10, the positioning of the rear rotary dial 62 and the path of the rear lace 80 is illustrated. As shown best in FIGS. 8-10, the rear lacing assembly defines a closure center line 106 that extends from a center portion of the rear rotary dial 62 towards an angular midpoint between the rear lace portion 84 and the front lace portion 88. The closure center line 106 is aligned with a medial arch region 108 that is commonly 30%-50% of the outsole length L from the heel end 26. The positioning of the closure center line 106 pulls the lateral part 34 of the upper 18 towards the medial arch region 108 of the user's foot when the rotary dial 62 is tightened. In some embodiments, the center line of the rear lateral strap 46 may be offset from the closure center line 106. This allows the rear lateral strap 46 to conform to different types of feet (e.g., flat/low doral instep, angled/high dorsal instep).

The rear lace portion 84 and front lace portion 88 each extend from the first rotary dial 62 and diverge from each other at a diverging angle $\alpha$. The diverging angle $\alpha$ between the rear lace portion 84 and front lace portion 88 is an acute angle (e.g., an angle of less than 90 degrees) so the rear lace portion 84 is directed towards the heel region of the medial side of the shoe 10 and the front lace portion 88 is directed towards the pedal region 92 (FIG. 3) of the medial side of the shoe 10. It is noted that no portions of the illustrated rear lace 80 overlap with other portions of the rear lace 80. In the illustrated embodiment, the diverging angle α is approximately 40 degrees.

Figure 7:
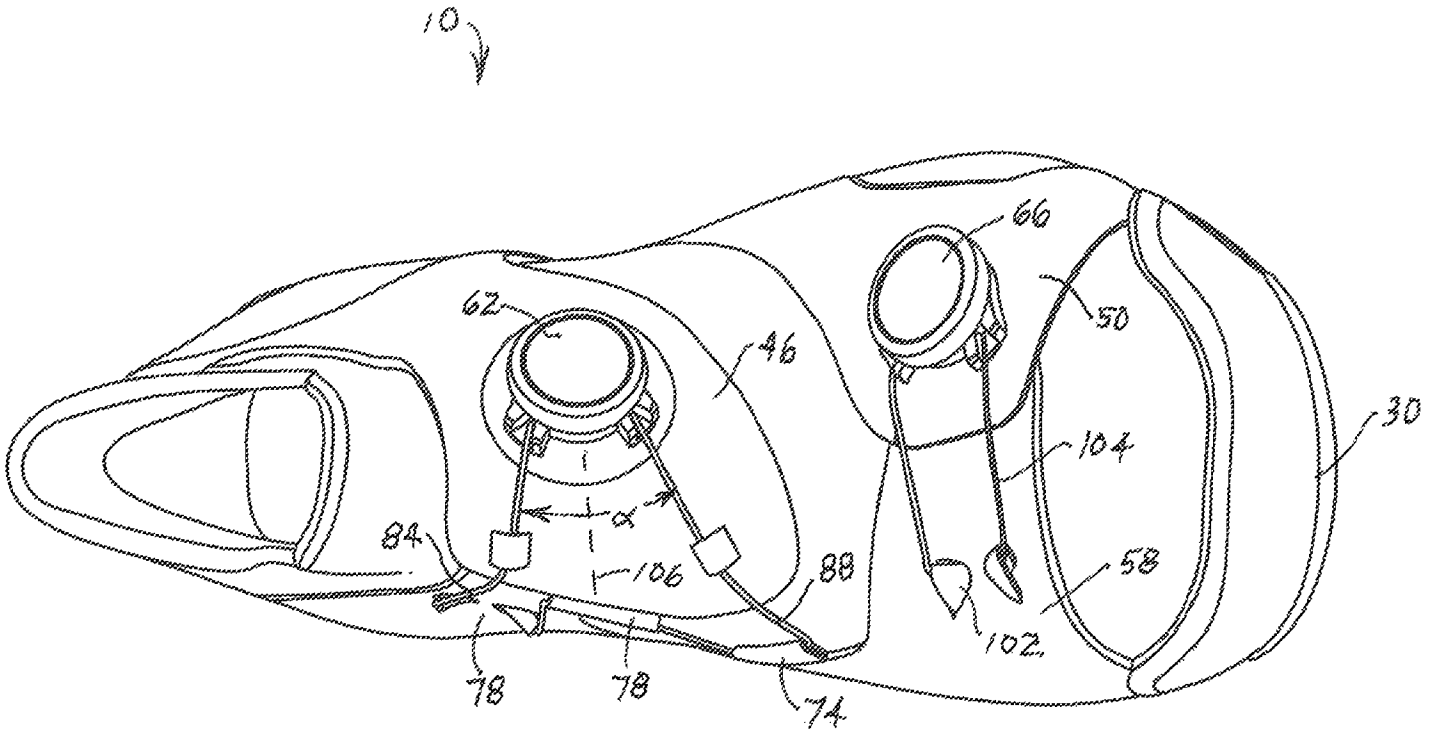
FIG. 7 is a perspective view of the cycling shoe in a first orientation normal to an upper of the shoe.
Figure 8:
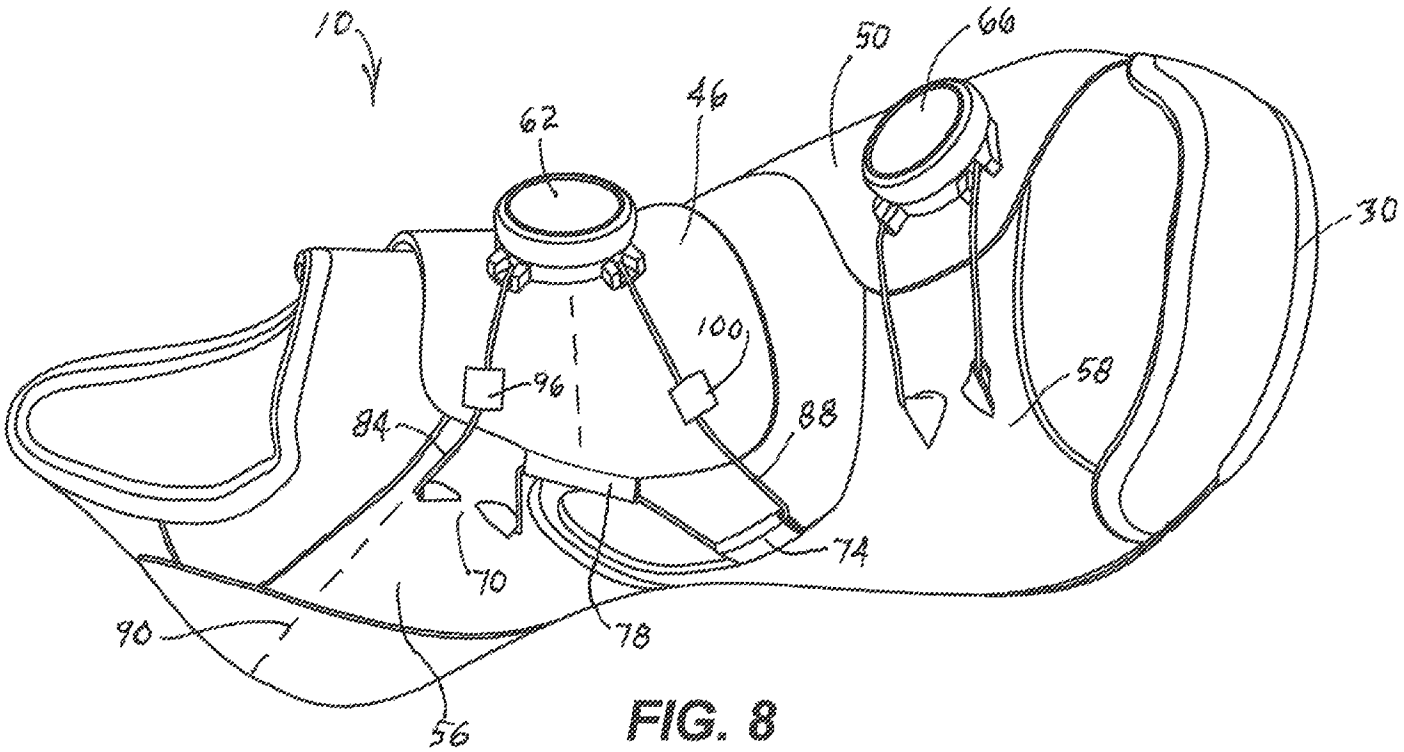
FIG. 8 is a perspective view of the cycling shoe in a second orientation normal to an upper of the shoe.
Figure 9:
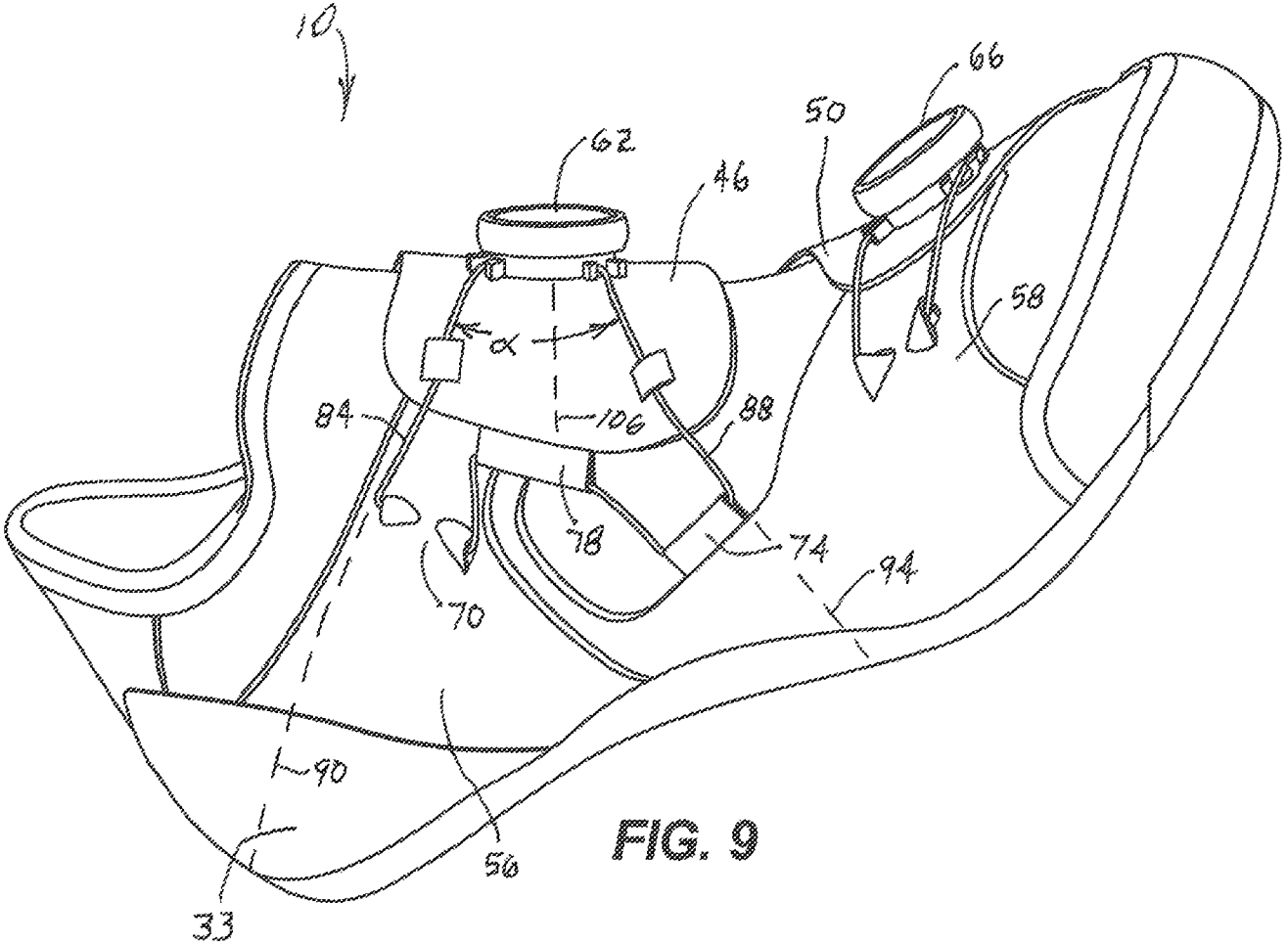
FIG. 9 is a perspective view of the cycling shoe in a third orientation normal to an upper of the shoe.
Figure 10:
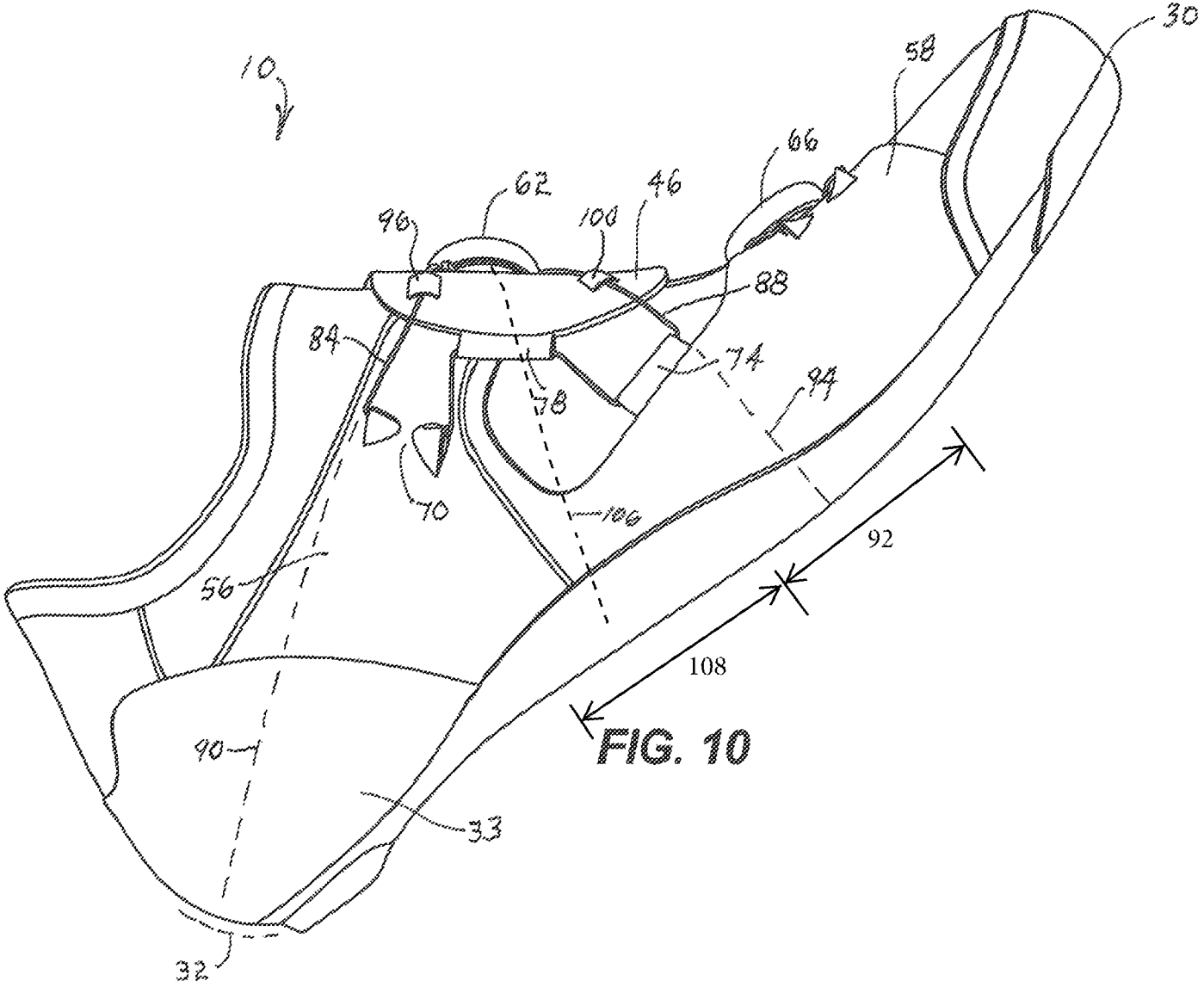
FIG. 10 is a perspective view of the cycling shoe in a fourth orientation normal to an upper of the shoe.

Since the shoe 10 has a three-dimensional geometry, FIGS. 7-10 are used to illustrate the three-dimensional path of the rear lace portion 84 towards the heel region 32 of the shoe. FIG. 7 illustrates the shoe 10 in an orientation that is normal to a portion of the upper 18 adjacent the rear rotary dial 62. FIGS. 8-10 illustrate the orientation of the shoe 10 normal to three different portions of the upper 18 as the rear lace portion 84 approaches the first lace guide 70.

When the rear lace 80 is attached to the first rotary dial 62 the rear lace 80 extends from the first rotary dial 62, through the fourth lace guide 96, through the first lace guide 70, through the third lace guide 78, through the second lace guide 74, through the fifth lace guide 100, and back to the first rotary dial 62. During operation, rotation of the first rotary dial 62 tightens both the rear lace portion 84 and the front lace portion 88. The rear lace portion 84 secures the rear lateral strap 46 of the lateral part 34 along the rear tightening path 90 (e.g., towards the heel region 32), the front lace portion 88 secures the rear lateral strap 46 of the lateral part 34 along the front tightening path 94 (e.g., towards the pedal region 92), and the portion of the rear lace 80 within the third lace guide 78 secures the rear lateral strap 46 along the closure center line 106. As a result, the tension on the rear lateral strap 46 is distributed between the heel region 32 and the pedal region 92.

The above-described shoe 10 is intended to create a unique way to hold the foot, with the main area of focus being that directly above the pedal spindle. The above-described forefoot closure (including the front lateral strap 50, the front medial strap 58, and the front lacing assembly 66,104) will allow for a more secure wrapping of the forefoot. The above-described rearfoot closure (including the rear lateral strap 46, rear medial strap 56, and the rear lacing assembly 62,80) is designed with the intent to enhance the structure of the shoe when the bike is in a sprint scenario and the bike can be pushed into extreme angles. In particular, the arch structure (including the diverging lace portions 84, 88 defining a closure centerline 106 intersecting the medial arch region 108) is designed to add stability and maintain foot hold to the outsole plate when the bike is being pushed into those extreme angles, especially within the arch of the shoe 10.

Various features of the disclosure are set forth in the following claims.

The invention claimed is:

1. An assembled, laced shoe comprising:

an outsole having a rear, heel end and a front, toe end opposite the heel end;

an upper coupled to the outsole above the outsole, wherein the upper defines an internal volume of the shoe and an opening of the shoe for insertion of a foot, wherein the heel end of the outsole is coupled to the upper to define a heel region, wherein a longitudinal centerline divides the shoe between a lateral side and a medial side and thus divides the upper between a lateral part and a medial part, wherein the lateral part includes a rear lateral strap that wraps across the centerline, wherein the lateral part further includes a front lateral strap, and wherein the medial part includes a front medial strap, wherein the front lateral strap extends toward the front medial strap, wherein the front medial strap extends toward the front lateral strap, wherein the rear lateral strap is spaced rearwardly away from both the front lateral strap and the front medial strap, and wherein the rear lateral strap includes a distal, free end; and a lacing system including:

a first rotary dial mounted on the rear lateral strap, and along the lateral part of the upper;

a first lace extending directly away from the first rotary dial and extending across the centerline to the medial part of the upper such that rotation of the first rotary dial tightens the first lace;

a second rotary dial mounted on the front lateral strap, and along the lateral part of the upper;

a second lace extending directly away from the second rotary dial and extending across the centerline to the front medial strap;

a first lace guide located on the medial side of the shoe, wherein the first lace guide is spaced away from the rear lateral strap;

a second lace guide located on the medial side of the shoe, wherein the second lace guide is spaced away from the rear lateral strap;

a third lace guide located on the distal, free end of the rear lateral strap;

wherein the first lace is a unitary lace that extends away from the first rotary dial, then through the first lace guide, then through the third lace guide, then through the second lace guide, and then back to the first rotary dial in a closed loop with the first rotary dial, wherein a distance between the third lace guide and the first rotary dial is less than a distance between the first lace guide and the first rotary dial, and wherein the distance between the third lace guide and the first rotary dial is less than a distance between the second lace guide and the first rotary dial, such that the first lace extends away from the first rotary dial toward the medial part of the upper, then returns toward the first rotary dial and the lateral part of the upper after passing through the first lace guide, then extends away again from the first rotary dial and toward the medial part of the upper after passing through the third lace guide, then returns back to the first rotary dial and toward the lateral part of the upper after passing through the second lace guide.

2. A shoe as claimed in claim 1, wherein the distal, free end of the rear lateral strap wraps at least 15 mm beyond the centerline of the shoe.

3. A shoe as claimed in claim 1, wherein the outsole further includes an outsole length between the heel end and the toe end, and a pedal region positioned 50%-70% of the outsole length from the heel end, and wherein a portion of the first lace is aligned with the pedal region.

4. A shoe as claimed in claim 1, further comprising a fourth lace guide and a fifth lace guide, wherein the fourth lace guide is positioned on the rear lateral strap and between the first rotary dial and the first lace guide and the fifth lace guide is positioned on the rear lateral strap and between the first rotary dial and the second lace guide.

5. A shoe as claimed in claim 1, wherein the outsole further includes an outsole length between the heel end and the toe end, and a medial arch region positioned 30%-50% of the outsole length from the heel end, wherein the lacing system defines a closure center line that extends from a center portion of the first rotary dial towards an angular midpoint between a first lace portion of the first lace and a second lace portion of the first lace, and wherein the closure center line is aligned with the medial arch region, wherein the first lace portion extends from the first rotary dial to the first lace guide, and wherein the second lace portion extends from the first rotary dial to the second lace guide.

6. A shoe as claimed in claim 1, wherein the front lateral strap does not extend across the centerline.

7. A shoe as claimed in claim 6, wherein the front medial strap extends across the centerline, and overlaps the front lateral strap.

8. A shoe as claimed in claim 1, wherein an entirety of the lacing system is disposed forward of the heel region, and wherein both the first dial and the second dial are disposed forward of the opening.

9. A shoe as claimed in claim 1, wherein the medial part of the upper includes a layer of material that extends adjacent and directly above the outsole, and extends along a direction toward the front toe end, before transitioning into the front medial strap.

10. A shoe as claimed in claim 9, wherein the upper includes a rear medial strap, wherein the rear medial strap is also formed from the layer of material, and wherein the rear lateral strap overlaps the rear medial strap.

11. A shoe as claimed in claim 1, wherein the closed loop is a first closed loop, wherein the lacing system further includes a fourth lace guide on the front medial strap, wherein the second lace extends away from the second rotary dial toward the medial part of the upper, then through the fourth lace guide, and then returns back toward the lateral side of the upper to the second rotary dial, forming a second closed loop separately spaced from the first closed loop.

* * * * *